United States Patent [19]

Epps et al.

[11] 4,394,912

[45] Jul. 26, 1983

[54] MOBILE CRANE HAVING TELESCOPING OUTRIGGERS AND POWER OPERATED SCREW MEANS FOR SAME

[75] Inventors: Stephen R. Epps; Narahari Gattu, both of Cedar Rapids, Iowa

[73] Assignee: Harnischfeger Corporation, W. Milwaukee, Wis.

[21] Appl. No.: 203,942

[22] Filed: Nov. 7, 1980

[51] Int. Cl.[3] ..... B66C 23/78; B66C 23/30

[52] U.S. Cl. ..... 212/189; 280/765.1; 280/766.1

[58] Field of Search ..... 212/189, 230, 264, 266, 212/267, 269; 280/764, 765, 766

[56] References Cited

U.S. PATENT DOCUMENTS

| | | | |
|---|---|---|---|
| 3,019,913 | 2/1962 | Bowman | 212/189 |
| 3,076,558 | 2/1963 | Berquist et al. | 212/230 |
| 3,278,046 | 10/1966 | Shumaker | 212/247 |
| 4,045,923 | 9/1977 | Shanmugasundaram | 212/269 |
| 4,084,777 | 4/1978 | Lambert | 212/189 |
| 4,298,128 | 11/1981 | Gattu | 212/230 |

FOREIGN PATENT DOCUMENTS

| | | | |
|---|---|---|---|
| 1173791 | 12/1969 | United Kingdom | 212/189 |
| 1215223 | 12/1970 | United Kingdom | 212/189 |

*Primary Examiner*—Trygve M. Blix
*Assistant Examiner*—C. T. Bartz
*Attorney, Agent, or Firm*—James E. Nilles

[57] ABSTRACT

A mobile crane having an extensible boom which is swingable about both a vertical and horizontal axis and having telescoping outriggers that extend transversely of the main frame of the crane and which outriggers are also pivotally mounted about a vertical axis for swinging between stowed position along the main frame and an extending crane operative position. Power operated extension means are provided for telescopingly adjusting the outriggers and includes a reversible hydraulic motor for rotating a threaded shaft. The telescoping outrigger includes a hollow box in which a hollow beam is telescopingly mounted.

9 Claims, 13 Drawing Figures

MOBILE CRANE HAVING TELESCOPING OUTRIGGERS AND POWER OPERATED SCREW MEANS FOR SAME

BACKGROUND OF THE INVENTION

Various types of telescoping outriggers have been proposed for stabilizing mobile cranes against tipping when its extensible load carrying boom is swung to various working positions. Hydraulic means have been proposed for providing the power for telescoping the outrigger sections relative to one another and such arrangements are shown in the U.S. Pat. No. 4,124,226 issued Nov. 7, 1978 to Phillips and is assigned to an assignee common with the present invention.

Some prior devices have had shortcomings because of their considerable weight and complexity, both in design and maintenance. Furthermore, some prior art devices were difficult to service, particularly when the hydraulic system was subject to leaking. Some prior outrigger devices would also shift or give slightly when subjected to concentrated compressive loads.

SUMMARY OF THE PRESENT INVENTION

The present invention provides a mobile crane of the type having an extendible boom that can be swung to various load handling positions thereby subjecting the crane to tipping, the crane having transversely extendible, telescoping outriggers and power operated screw means for extending the telescoping members of the outriggers. A more specific aspect of the invention relates to outriggers of the above type which are pivoted about a vertical axis to the main frame of the machine so they can be swung from a stowed position along the main frame to an outer transverse position for stabilizing the crane when the boom is in operation. A more specific aspect of the invention relates to a reversible hydraulic motor that drives an elongated threaded shaft which in turn is engaged by a non-rotatable threaded member whereby rotation of the threaded shaft causes telescoping movement of the outrigger. The construction of the outrigger includes a recess or pocket at its inner end which is freely accessible and in which the hydraulic motor is mounted. With this construction the motor is located in an out-of-the-way and protected location and free of interference from men working in the area or from swinging loads that may pass through that area.

An additional aspect of the invention relates to widely spaced apart slider pads between the relatively telescoping box and beam of the outrigger and which act to distribute the load over a wide area for uniform distribution and accommodation of high compressive forces, particularly when the outriggers are extended. The outrigger construction is particularly rigid and strong having a good strength/weight ratio capable of absorbing bending moments or loads in both vertical and horizontal directions. Furthermore, the outrigger construction is stable in operation and will not shift or otherwise move under load.

These and other objects and advantages of the present invention will appear hereinafter as this disclosure progresses, reference being had to the accompanying drawings.

DESCRIPTION OF A PREFERRED EMBODIMENT

GENERAL ORGANIZATION

Figure 1:
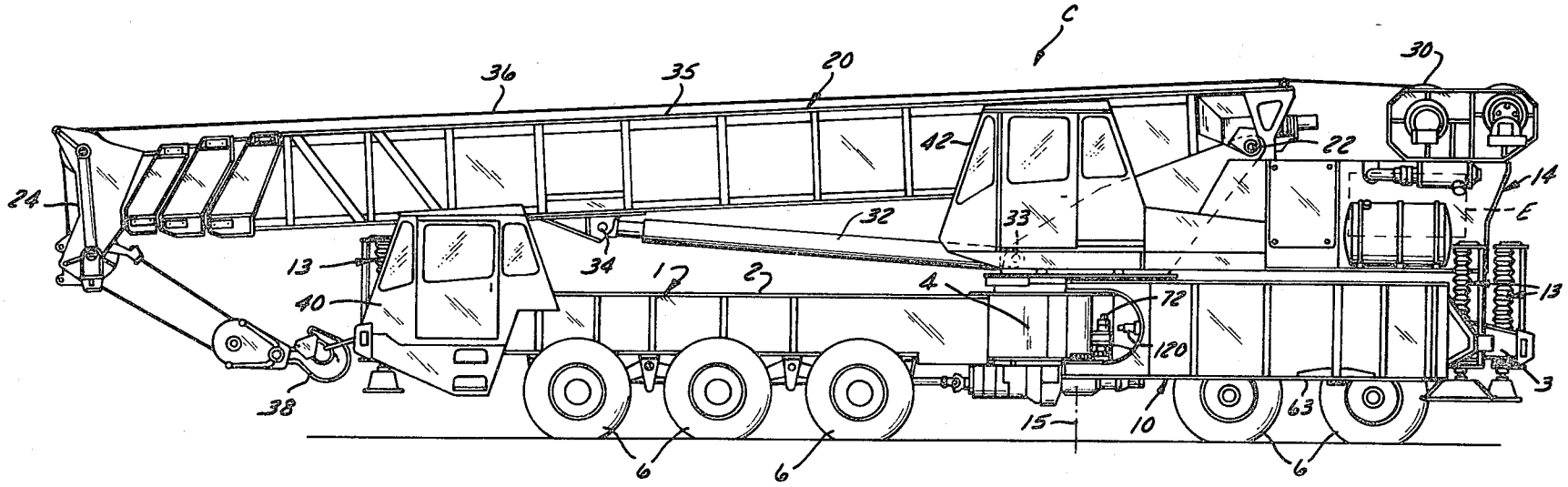
FIG. 1 is an elevational view taken from the left side of a truck crane and showing the extensible outriggers swung to the stowed position along the main frame.
Figure 2:
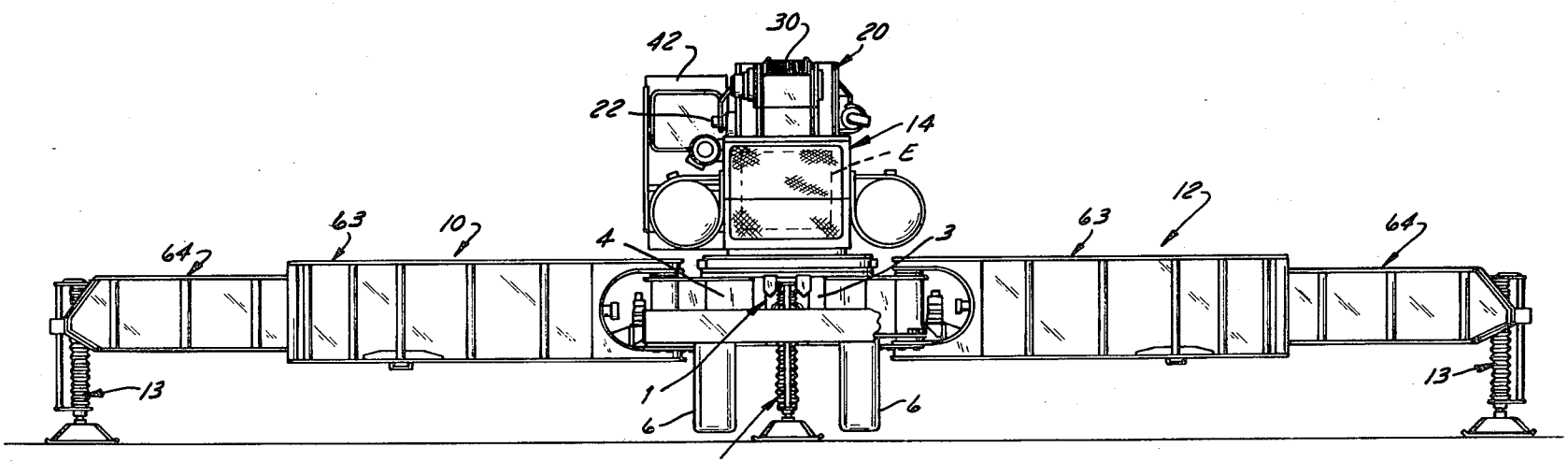
FIG. 2 is a rear view of the crane shown in FIG. 1, but with the outriggers swung away from the main frame and extended and with all four jacks in the ground engaging position.

The general organization of a self-propelled truck crane C shown for the purpose of illustrating the present invention is shown in FIGS. 1 and 2 and includes an elongated main frame 1 comprising a tubular front portion 2 and a tubular rear portion 3 which are both of rectangular transverse cross section and fabricated from steel plates that are welded together. The main frame also includes an intervening tub 4 to which adjacent ends of the front and rear portions are welded to form a unitary main frame. Ground engaging wheels 6 are located and attached by suspension means to the lower portion of the main frame to permit the crane to be transported to and from the job site over the highway or other terrain.

A pair of transversely extendible outriggers 10 and 12 are extendible from each side of the main frame and are pivotably connected to their respective sides of the tub of the main frame. These outriggers are swingable from the transport position shown in FIG. 1 where they are located in a stowed position generally parallel with and alongside the main frame and any one of a number of transversely extending positions outwardly of the main frame for stabilizing the truck crane where the boom is in operation.

A vertically extendible ground engaging jack 13 is located at each of the forward and rearward ends of the main frame and also at each of the outer ends of the two outriggers, providing four widely spaced apart jacks for stabilizing the crane against tipping when the boom is in the working position.

The crane also includes a superstructure 14 which is rotatably mounted about a vertical axis 15 on the upper portion of the tub 4 and is capable of rotating 360°. An extendible, telescoping boom 20 is pivotable about a horizontal shaft 22 at the upper end of the superstructure so that the boom can be vertically positioned about the horizontal axis 22. The boom is comprised of several telescoping sections so that its free end containing the boom point 24 (FIG. 1) can be extended many feet into the air. Certain essential elements of the crane are mounted on the superstructure such as the winch 30 and the power source E which may take the form of an internal combustion engine.

The boom itself may be of conventional construction and when fully extended it may reach a height of several hundred feet. The boom is vertically positioned by a large hydraulic cylinder 32 pivoted about a horizontal axis 33 to the superstructure and also pivoted at its forward end at 34 (FIG. 1) intermediate the length of the base section 35 of the boom. A load line 36 extends from the winch 30 over conventional pulleys on the boom point and it is connected to the load hook 38 in the known manner.

An operator's cab 40 is located on the front end of the main frame and in which the operator is located for driving the crane in the transport mode. Another operator's cab 42 containing appropriate controls, is located on the superstructure and is used for operating various components of the boom and crane when the crane is in the operating, boom operative mode.

Figure 4:
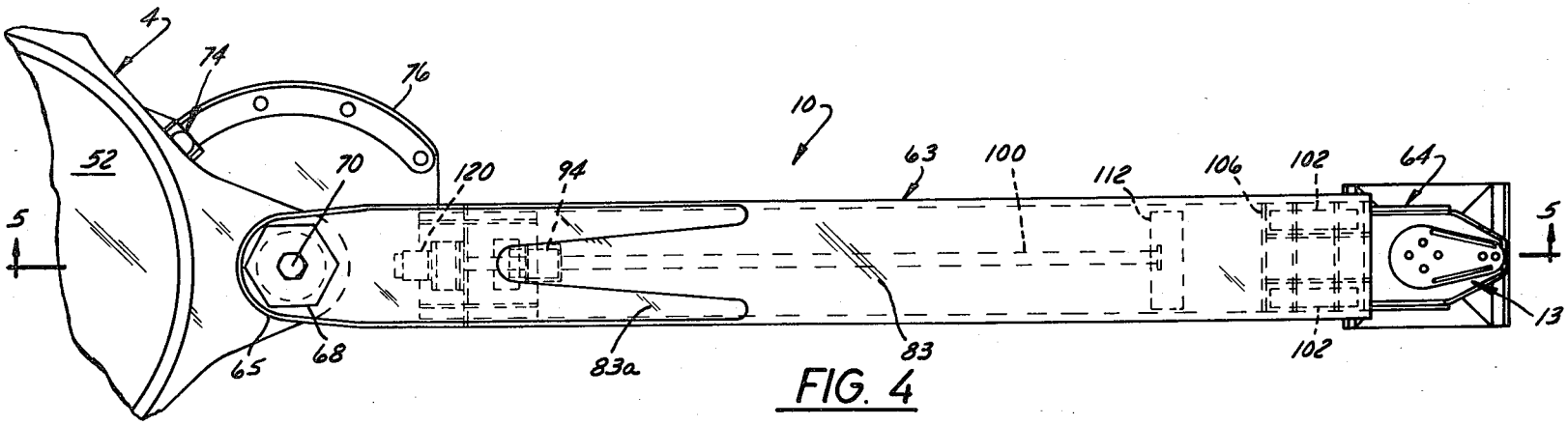
FIG. 4 is a plan view of the telescoping outrigger attached to the main frame.

The tub 4 is fabricated from steel and includes a cylindrical steel member 50 having its longitudinal axis disposed in a vertical direction so that the tub is circular when viewed in plan. The tub construction includes a horizontal top plate 52 and a horizontal bottom plate 53 which both extend transversely beyond each side of the tub and which are welded to the upper and lower ends of the cylindrical member 50 to form a rigid unitary construction. A steel tube 56 (FIGS. 4 and 5) is welded between the horizontal plates 52 and 53, and at each side of the tub to provide a pivotal mounting means for mounting the outriggers 10 and 12, one at each side of the main frame.

Steel gusset plates 57 are provided between the upper and lower plates 52, 53 and are welded thereto.

The details of the construction of the main frame including the front portion 2, the rear portion 3 and the tub 4 are shown and described in the co-pending United States patent application Ser. No. 203,941, filed Nov. 7, 1980 and reference may be had to that application if a more complete description of the structure and advantages thereof are deemed to be either necessary or desirable.

Figure 13:
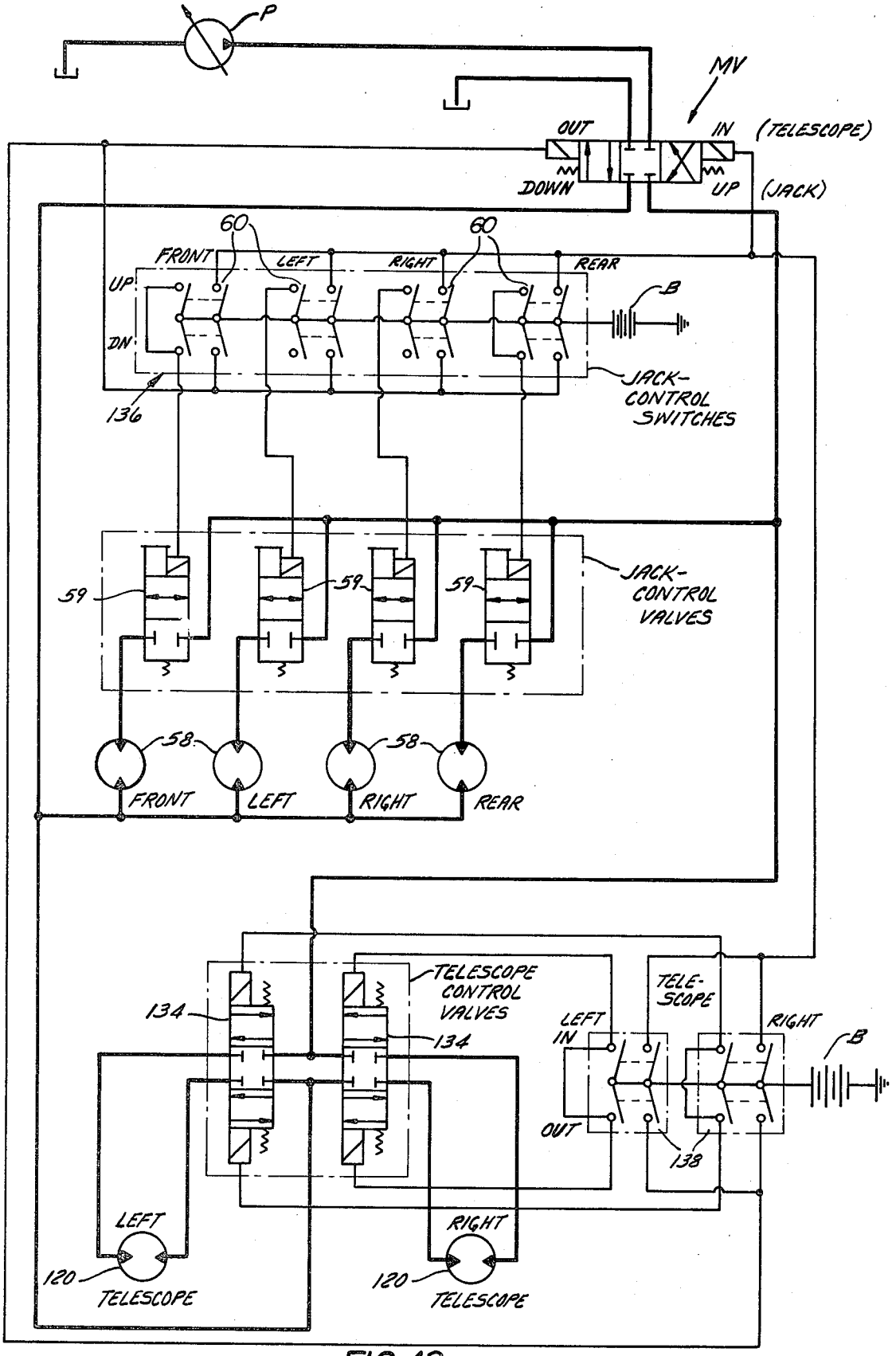
FIG. 13 is a control circuit for operating the ground engaging jacks and extension and retraction of the outriggers.

The vertically positioned, ground engaging jack 13 is provided at both the front and rear ends of the main frame and also provided at each of the outer ends of the outriggers. These jacks can be power operated from a raised position shown in FIG. 1 for transport of the crane and a ground engaging, crane operating position shown in FIG. 2. As shown in FIG. 13, a hydraulic motor 58, a solenoid operated, hydraulic control valve 59, and a manually operated electric switch 60 thereof, are provided for each of these jacks, shown and described in the co-pending United States patent application Ser. No. 203,943 filed Nov. 7, 1980 and reference may be had to that application if a more complete description of the construction and operation of the jacks is deemed to be either necessary or desirable.

OUTRIGGERS

Figure 3:
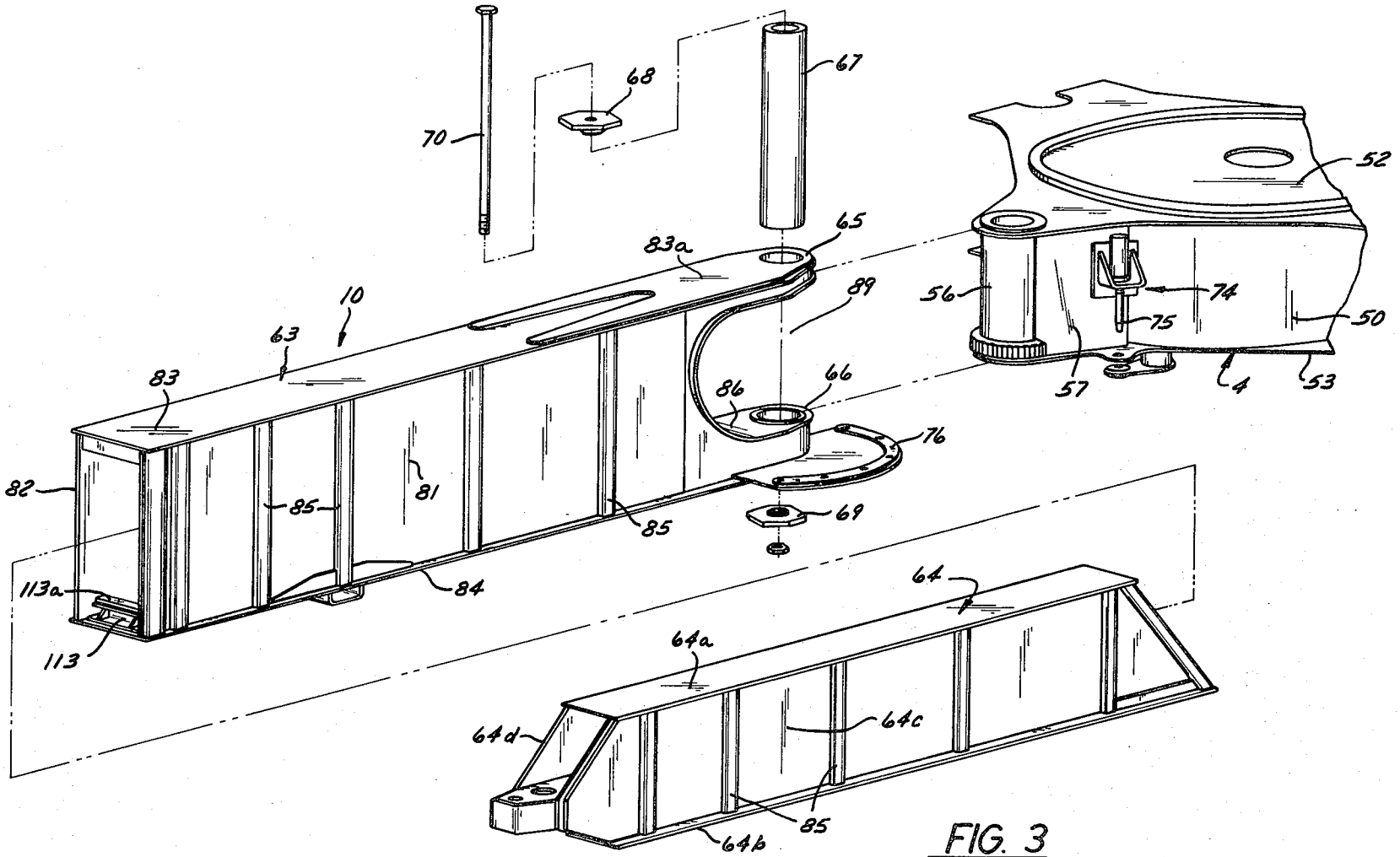
FIG. 3 is an exploded, perspective view of a portion of the main frame and one of the transverse telescoping outriggers which is attachable to one side of the main frame.
Figure 6:
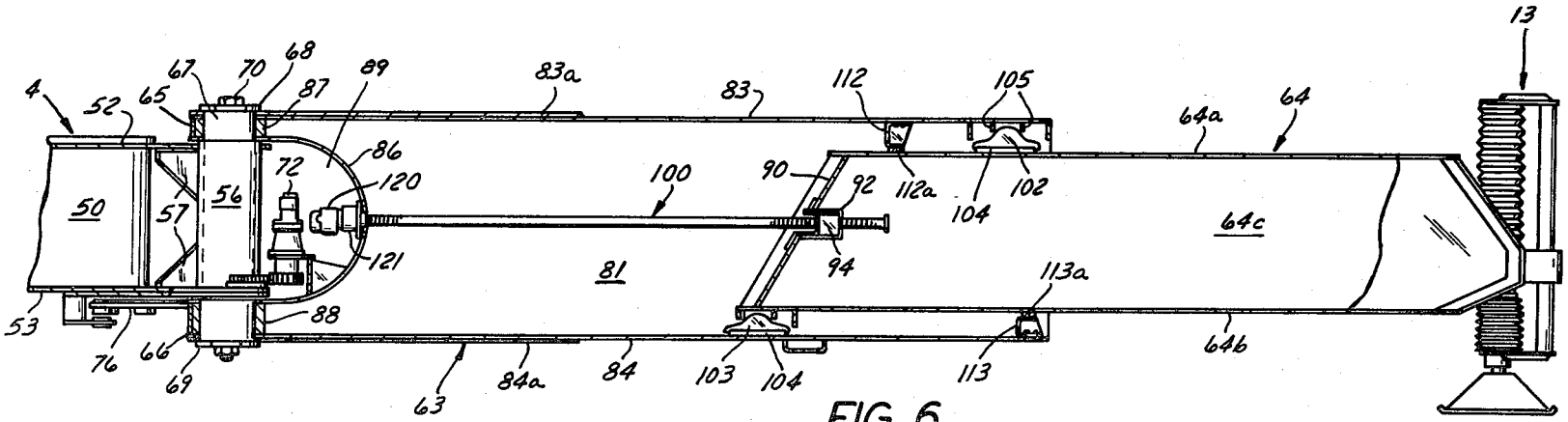
FIG. 6 is a view similar to FIG. 5, but on a reduced scale, and with the outrigger extended.

The outriggers 10 and 12 (FIG. 2) are identical in construction and reference will be made to only one of them. As shown in FIG. 3, the outrigger 10 includes an outer generally hollow and elongated box 63 and an elongated inner beam 64 telescopingly mounted within the box, both the box and the beam being of rectangular cross section and fabricated from steel plates which are welded together. The inner end of the box 63 is bifurcated into an upper part 65 and a lower part 66 (FIGS. 3 and 6).

A pivot tube 67 extends through aligned holes in the upper part 65 and lower part 66 of the outrigger and also through the tube 56 welded in the tub. Upper and lower caps 68 and 69 are located on the ends of the tube 67 and a bolt means 70 extends through the assembly to rigidly hold the unit in assembled relationship.

Power operated means 72 for swinging in a horizontal direction are shown and described in the co-pending United States patent application Ser. No. 203,944, filed Nov. 7, 1980 and reference may be had to that application if deemed to be necessary or desirable.

Power operated locking means 74 mounted on the main frame (FIG. 3) including a hydraulically operated, extensible pin 75 engageable in a locking plate 76 secured to the outrigger is shown and described in the co-pending United States patent application Ser. No. 203,944, filed Nov. 7, 1980 and assigned to an assignee common with the present invention. Reference may be had to that application if a more complete description of its structure and function is desired.

Referring again in greater detail to the construction of the outriggers 10 and 12, the beam 64 is formed by the upper side **64*a*, lower side 64*b* and the two vertical sides 64*c* and 64*d*. The box has a pair of opposite vertical walls 81 and 82, a top plate 83 and a bottom plate 84. The top and bottom plates of the box have reinforcing plates 83*a* and 84*a*, respectively, welded along their inner ends. As shown in FIG. 3, vertically disposed, channel shaped stiffeners 85 are welded at spaced locations along the length of the side walls of the box 63 and beam 64**. This permits the use of side walls which are thinner than the top and bottom plates.

Figure 8:
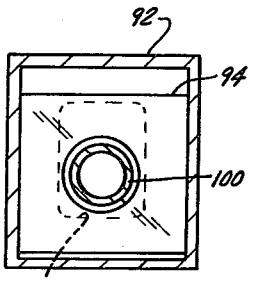
FIG. 8 is a transverse, vertical sectional view taken along line 8—8 in FIG. 7.
Figure 7:
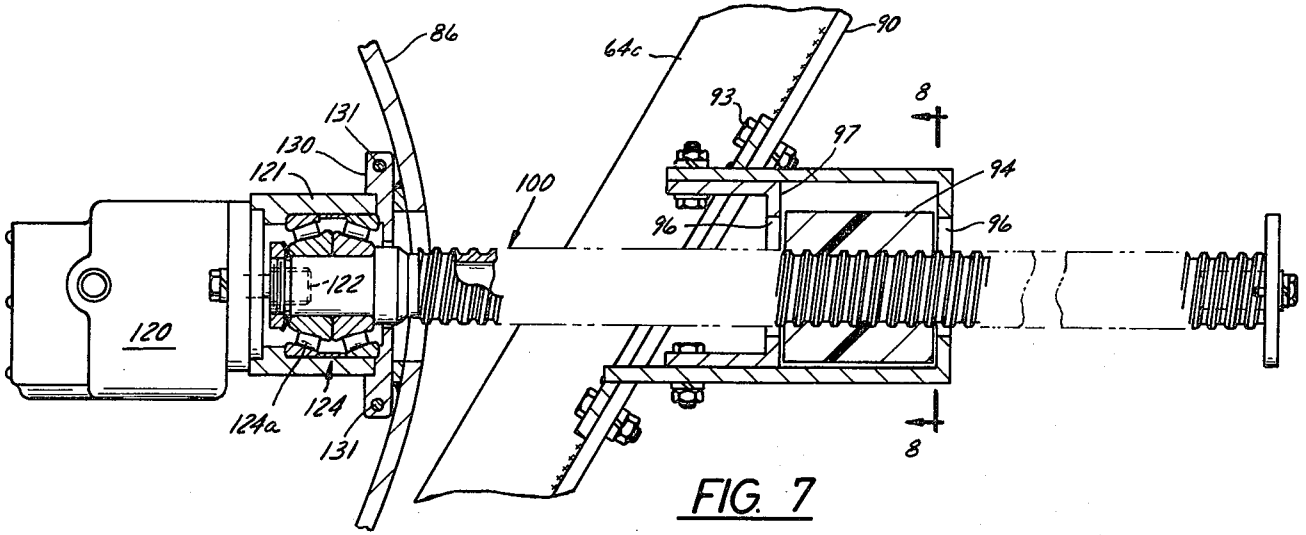
FIG. 7 is a fragmentary, sectional view of a portion of the showing in FIG. 5, but on an enlarged scale.

A generally semi-cylindrical wall or plate 86 is welded to the inner end of the box and thereby defines a recessed pocket 89 that faces the main frame. The box also includes a pair of collars 87 and 88 welded to the inner ends of the upper and lower plates and to the curved plate 86. These collars have vertically aligned apertures through which the tube 67 extends. The beam 64 has an inner end wall 90 that is welded transversely across its side and top and bottom plates and, when the beam is in the position shown in FIG. 5, the lower end of the inclined wall 90 is nested generally under the curved wall 86. As will appear later, this construction permits the beam to be nested within the box as far as possible to give additional bearing support in the box. The inner wall 90 has a bracket or cage 92 fabricated from steel and fixed thereto by suitable bolt means 93 as clearly shown in FIG. 7. Within this cage is positioned an internally threaded member 94 which is preferably formed from a plastic such as Nylatron$_{TM}$ made by the Polymer Corporation of Reading, Pennsylvania. This Nylatron material is self-lubricating, of light-weight construction and has good wear characteristics. It will be noted that the threaded member 94 is generally rectangular in shape (FIG. 8) and non-rotatable relative to the beam. It should also be noted that a small clearance (FIG. 7) is provided between the interior of two opposed walls of cage 92 and the threaded member 94 so as to permit the member 94 to rise and fall in the cage slightly and accommodate bending or tilting movement of the beam relative to the box as the beam is extended outwardly, as will more fully appear. It should also be noted that slots 96 are formed in the walls 97 of the cage to permit an elongated tubular and externally threaded shaft 100 to also rise and fall slightly when the beam is moved relative to the box.

The threaded shaft 100, has threads which are of a self-locking form, the angle of the threads being such that the shaft will not turn by itself when a load is imposed on it, thereby not requiring conventional locks to prevent accidental movement. This thread form provides good speed, good locking and good efficiency in an environment of this type. The screw shaft 100 is made tubular for weight reduction and also because this tubular structure will handle the compressive loads imposed on it in an efficient manner.

The above motor and screw shaft construction and location does not require surrounding housings and permits all hydraulic components with potential leakage, to be located externally and of easy access.

Figure 5:
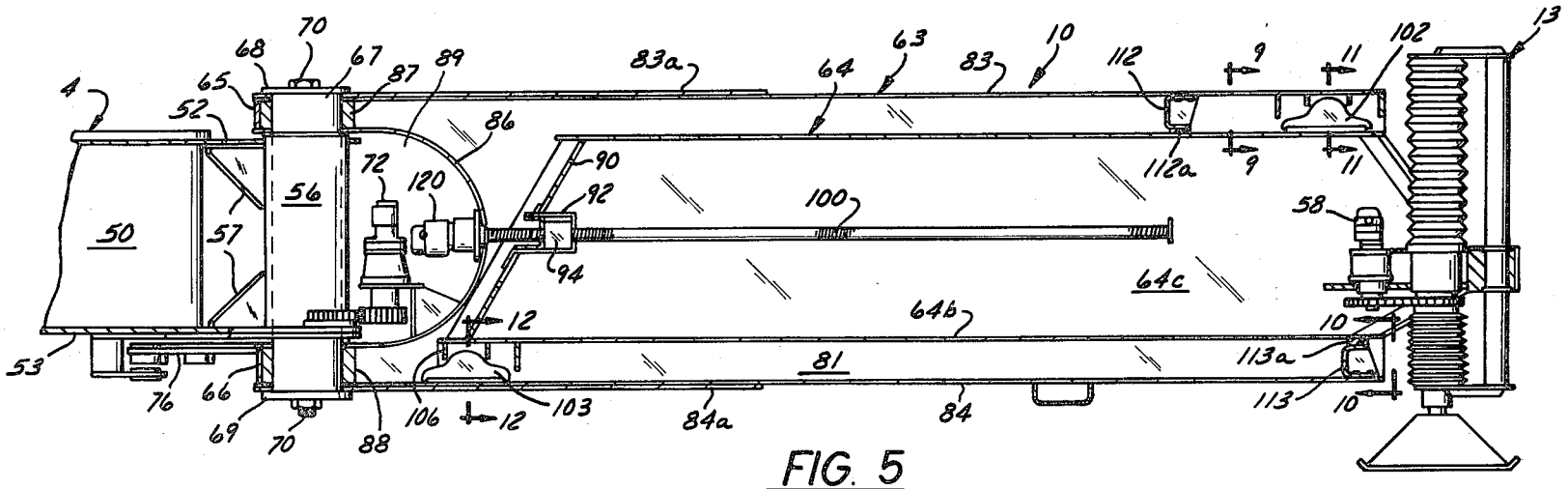
FIG. 5 is a vertical sectional view taken generally along the line 5—5 in FIG. 4 and showing the power screw extension means and slide pads for the outrigger.
Figure 9:
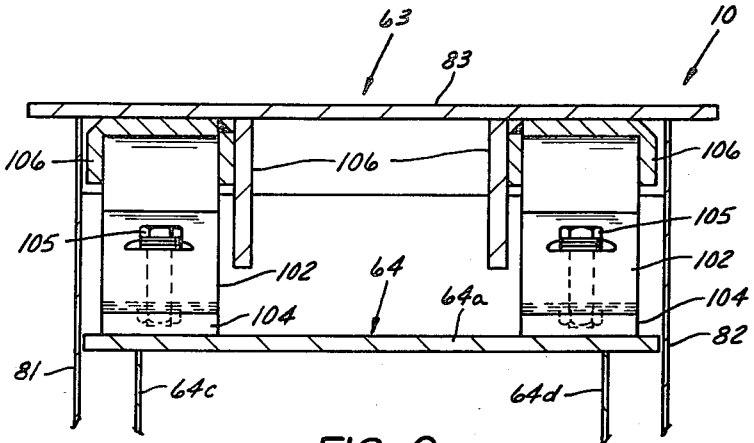
FIG. 9 is a sectional view, on an enlarged scale, taken along line 9—9 in FIG. 5.
Figure 12:
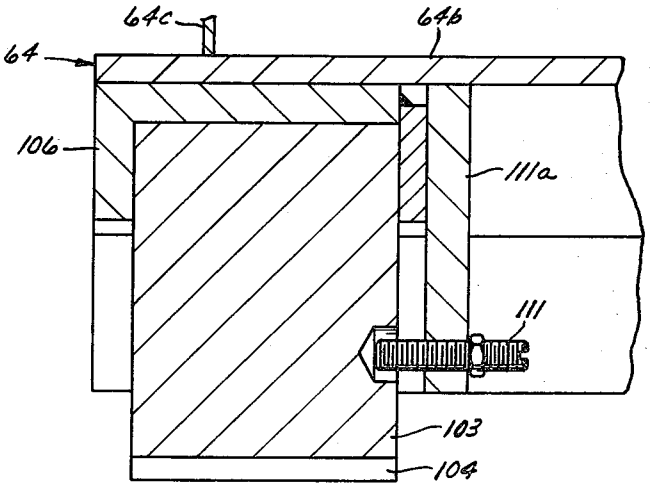
FIG. 12 is a sectional view, on an enlarged scale, taken along line 12—12 in FIG. 5.
Figure 11:
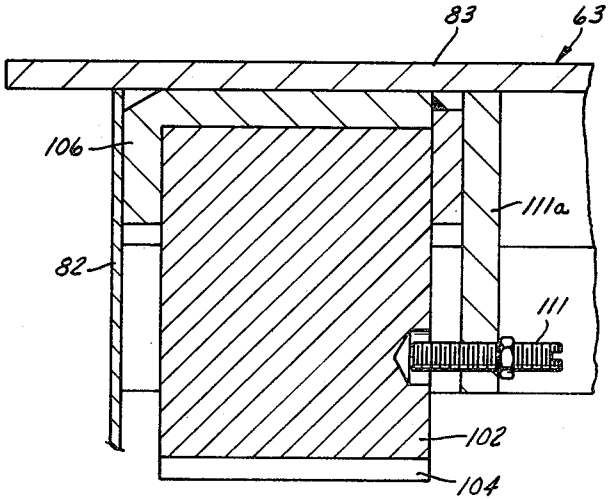
FIG. 11 is a sectional view, on an enlarged scale, taken along line 11—11 in FIG. 5.

Pairs of transversely spaced pivotal sliders 102 and 103 are inserted in the spaces between the box and beam (FIGS. 5 and 6), these sliders having pads 104 (also see FIGS. 9, 11 and 12) secured by bolt means 105 at their lower sides and which are made of the said Nylatron material. The sliders are swivelly mounted, that is, they are relatively loosely mounted and each are loosely confined by a pair of spaced apart transverse projections 106 secured to and extending from the interior of the upper wall of the box and also extending from the inner lower end of the beam as shown in FIGS. 5 and 6. This construction permits the pads to tilt slightly and accommodate slight movement between the beam and the box as telescoping movement occurs. Threaded set screws 111 screwed into frame braces 111*a* (FIGS. 11 and 12) hold the mounting pads in loosely assembled relationship with their respective beam and box.

Figure 10:
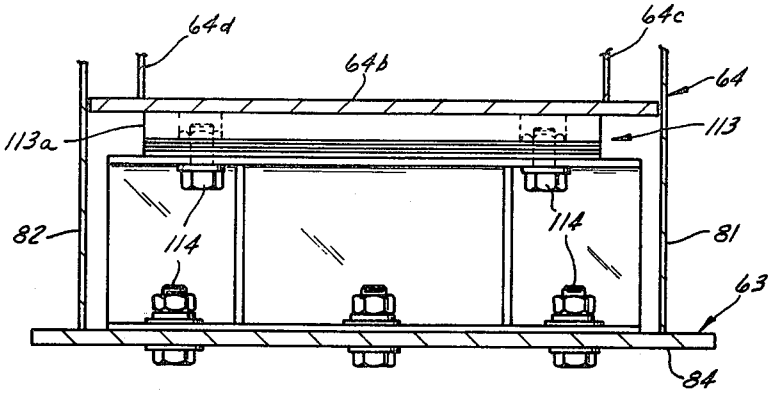
FIG. 10 is a sectional view, on an enlarged scale, taken along line 10—10 in FIG. 5.

Bearing members 112 and 113 are also mounted in the upper and lower spaces, respectively, between the box 63 and beam 64 by suitable bolt means 114 (FIG. 10). Specifically, the channel shaped bearing members 112 and 113 are fixed, respectively, to the interior surfaces of the upper wall 83 and lower wall 84 of the box 63 and present Nylatron material bearings 112*a* and 113*a*, respectively against which the beam can slide.

Power operated extension means in the form of a reversible hydraulic motor 120 is mounted to the curved plate 86 of the box and more specifically within the pocket 89 at the inner end of the box as shown in FIGS. 4–7. This motor has good low speed torque characteristics and may be of the type manufactured by the Washington Scientific Industries, Company. The output shaft 122 (FIG. 7) of the motor is fixed to the inner end of the threaded tubular member 100 in a tubular housing 121 so that the motor can rotate the shaft 100 in either direction. A suitable anti-friction bearing assembly 124 is interposed between the shaft and the tubular housing 121, the outer race 124*a* being press-fit into the housing 121. The housing in turn is secured to the plate 86 by means of the split, slide ring collar 130 secured by screws 131. In this manner the motor 120 is detachable but rigidly mounted to the recessed pocket 89 of the box 63 and is easily accessible for repair or replacement.

As previously mentioned, the inclined wall 90 of the inner end of the beam nestles under the curved wall 86 when in the retracted position to get full retraction of the beam. Also with this construction, when the beam is fully extended as shown in FIG. 6, the distance between the bearing member 113 and the slider 103 is considerable, and by maximizing this spread, the forces on the outriggers are minimized. This construction gives uniform loading across the entire length of the outrigger and which can accommodate deflection of the outrigger in either direction, that is vertical bending loads or side bending loads, all with relatively inexpensive construction and maintenance-free operation.

FIG. 13

FIG. 13 is a control circuit diagram of the hydraulic and electrical components of the control system for the jacks 13 and motors 120 for telescopic movement of the outriggers above described. Fluid pressure for the hydraulic components is supplied by a variable displacement hydraulic pump P which is driven by the engine E. The power for the electrical components is supplied from the batteries B of the crane. The jack motors 58 and the hydraulic motors 120 are controlled through electrical solenoid operated control valves 59 and 134, respectively, with push-button controls 136 and 138, respectively, all conveniently located on the crane.

A solenoid operated hydraulic mode control valve MV is actuated by the push-buttons to prevent simultaneous operation of the hydraulic vertical jack motors 58 and the hydraulic outrigger motors 120.

We claim:

1. A mobile crane comprising, an elongated main frame, ground engaging means on said frame for supporting said frame for movement over the ground, a superstructure rotatably mounted on said frame and having an elevational boom pivoted thereto; and a pair of outriggers each having an inner end pivotally secured to said main frame at a location intermediate the length of said frame, said inner end of said outriggers is of bifurcated construction and defines an outwardly facing recessed pocket, vertically positionable ground engageable means carried by the outer end of said outriggers, one outrigger being secured to said frame at each side thereof and about a vertical axis for swinging between a transport position alongside said elongated main frame and a boom operative position extending transversely outwardly of said main frame, said outriggers comprising an elongated box and an inner beam telescopingly slideable within said box for contraction within said box and extending from said box, power operated extension means mounted between said box and beam of each of said outriggers for telescopingly sliding said beam relative to said box, said extension means comprising reversible motor means mounted in said recessed pocket of said box and having an elongated threaded shaft extending from and rotatable in either direction by said motor means, and a non-rotatable threaded member carried by said beam and threadably engageable by said threaded shaft, whereby rotation of said shaft causes telescoping movement of said beam with said box.

2. The crane set forth in claim 1 further characterized in that said beam is of hollow construction, said power operated motor means includes a reversible hydraulic motor and said threaded shaft extends therefrom and into said hollow beam.

3. The crane set forth in claim 1 further characterized in that said recessed pocket is formed by a generally U-shaped plate extending transversely across said inner end of said outrigger and said motor means is secured to said U-shaped plate, and said threaded shaft extends longitudinally within said box and beam of said outrigger.

4. The crane set forth in claim 3 further characterized in that said beam has an inner end within said box, said inner end being formed by an inclined plate extending transversely across said beam, said inclined plate being inclined in a downwardly and inwardly position whereby said inclined plate can be located at least partially under said generally U-shaped plate of said box when said beam is contracted within said box.

5. The crane set forth in claim 3 including sliders mounted between said box and beam at spaced locations between said box and beam, one of said sliders adapted to be positioned beneath said U-shaped plate of said box when said beam is retracted within said box.

6. The crane set forth in claim 1 further characterized in that said box and beam are both of rectangular cross section and have two vertical side plates welded to a top plate and a bottom plate, said side plates having vertically disposed stiffeners welded along the side plates at spaced locations therealong.

7. A mobile crane comprising, an elongated main frame, ground engaging means on said frame for supporting said frame for movement over the ground, a superstructure rotatably mounted on said frame and having an elevational boom pivoted thereto; and a pair of outriggers each having an inner end pivotally secured to said main frame at a location intermediate the length of said frame, said inner end of said outriggers is of bifurcated construction and defines an outwardly facing recessed pocket, vertically positionable ground engageable means carried by the outer end of said outriggers, one outrigger being secured to said frame at each side thereof and about a vertical axis for swinging between a transport position alongside said elongated main frame and a boom operative position extending transversely outwardly of said main frame, said outriggers comprising an elongated box and an inner beam telescopingly slideable within said box for contraction within said box and extending from said box, power operated extension means mounted between said box and beam of each of said outriggers for telescopingly sliding said beam relative to said box, said recessed pocket being formed by a generally U-shaped plate extending transversely across said inner end of said outrigger and said motor means is secured to said U-shaped plate, said means comprising reversible motor means mounted on said U-shaped plate and in said pocket and having an elongated threaded shaft extending longitudinally within said box and beam of said outrigger, said threaded shaft extending from and rotatable in either direction by said motor means, and a non-rotatable threaded member carried by said beam and threadably engageable by said threaded shaft, whereby rotation of said shaft causes telescoping movement of said beam with said box, said beam having an inner end within said box, said inner end being formed by an inclined plate extending transversely across said beam, said inclined plate being inclined in a downwardly and inwardly position whereby said inclined plate can be located at least partially under said generally U-shaped plate of said box when said beam is contracted within said box.

8. A mobile crane comprising, an elongated main frame, ground engaging means on said frame for supporting said frame for movement over the ground, a superstructure rotatably mounted on said frame and having an elevational boom pivoted thereto; and a pair of outriggers each having an inner end pivotally secured to said main frame at a location intermediate the length of said frame, said inner end of said outriggers being of bifurcated construction and defining an outwardly facing recessed pocket, said recessed pocket being formed by a generally U-shaped plate extending transversely across said inner end of said outrigger, vertically positionable ground engageable means carried by the outer end of said outriggers, one outrigger being secured to said frame at each side thereof and about a vertical axis for swinging between a transport position alongside said elongated main frame and a boom operative position extending transversely outwardly of said main frame, said outriggers comprising an elongated box and an inner beam telescopingly slideable within said box for contraction within said box and extending from said box, said beam being of hollow construction, power operated extension means mounted between said box and beam of each of said outriggers for telescopingly sliding said beam relative to said box, said extension means including a reversible hydraulic motor mounted on said U-shaped plate and having an elongated threaded shaft extending therefrom and rotatable in either direction, said threaded shaft extending longitudinally within said box and beam of said outrigger; and a non-rotatable threaded member carried by said beam and threadably engageable by said threaded shaft, whereby rotation of said shaft causes telescoping movement of said beam within said box, said beam having an inner end within said box, said inner end being formed by an inclined plate extending transversely across said beam, said inclined plate being inclined in a downwardly and inwardly position whereby said inclined plate can be located at least partially under said generally U-shaped plate of said box when said beam is contracted within said box.

9. The crane set forth in claim 8 including sliders mounted between said box and beam at spaced locations between said box and beam, one of said sliders adapted to be positioned beneath said U-shaped plate of said box when said beam is retracted within said box.

* * * * *